US006769361B2

(12) United States Patent
Yamamoto et al.

(10) Patent No.: US 6,769,361 B2
(45) Date of Patent: Aug. 3, 2004

(54) PRINTING MACHINE FOR CONTROLLING FEEDING RATES BY COLOR DENSITY MEASUREMENT

(75) Inventors: Takaharu Yamamoto, Kyoto (JP); Shigeo Murakami, Kyoto (JP); Nobuhito Kohara, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/408,114

(22) Filed: Apr. 8, 2003

(65) Prior Publication Data

US 2003/0217658 A1 Nov. 27, 2003

(30) Foreign Application Priority Data

May 21, 2002 (JP) ..... 2002-146696

(51) Int. Cl.[7] ..... B41F 31/00; B41F 1/54

(52) U.S. Cl. ..... 101/350.1; 101/484; 101/365

(58) Field of Search ..... 101/148, 211, 101/467, 483, 177, 350.1, 463.1, 136, 350.4, 365, 183, 484, 130, 450.1; 347/15, 123, 1.9

(56) References Cited

U.S. PATENT DOCUMENTS 3,835,777 A * 9/1974 Krygeris ..... 101/350.4
4,151,796 A * 5/1979 Uhrig ..... 101/142
4,210,078 A * 7/1980 Greiner et al. ..... 101/136
4,428,287 A * 1/1984 Greiner ..... 101/170
4,453,463 A * 6/1984 Dahlgren et al. ..... 101/148
4,649,502 A * 3/1987 Keller et al. ..... 358/1.9
4,706,206 A * 11/1987 Benoit et al. ..... 382/167
4,852,485 A * 8/1989 Brunner ..... 101/211
4,864,930 A * 9/1989 Runyan et al. ..... 101/365
4,955,290 A * 9/1990 Kipphan et al. ..... 101/183
4,971,446 A * 11/1990 Kurata ..... 356/402
4,972,774 A * 11/1990 MacPhee ..... 101/450.1
5,029,527 A * 7/1991 Jeschke et al. ..... 101/365
5,182,721 A * 1/1993 Kipphan et al. ..... 382/112
5,237,923 A * 8/1993 Williams et al. ..... 101/467
5,713,286 A * 2/1998 Zorn ..... 101/450.1
5,791,249 A 8/1998 Quadracci
5,903,712 A * 5/1999 Wang et al. ..... 358/1.9
5,907,999 A * 6/1999 Lusar et al. ..... 101/484
5,967,050 A * 10/1999 Seymour ..... 101/484
6,009,807 A * 1/2000 Yoshida et al. ..... 101/177
6,024,018 A * 2/2000 Darel et al. ..... 101/365
6,422,142 B2 * 7/2002 Steinbacher ..... 101/211
6,450,097 B1 * 9/2002 Kistler et al. ..... 101/483
6,539,863 B2 * 4/2003 Shiraishi ..... 101/365
6,546,870 B2 * 4/2003 Mayer et al. ..... 101/483
6,601,512 B2 * 8/2003 Yamamoto et al. ..... 101/484
6,615,725 B2 * 9/2003 Kurata et al. ..... 101/483
6,622,626 B2 * 9/2003 Stuhlmiller et al. ..... 101/484
2001/0018875 A1 * 9/2001 Shiki et al. ..... 101/365
2002/0043166 A1 4/2002 Okuda
2003/0058462 A1 * 3/2003 Martinez et al. ..... 358/1.9
2003/0217654 A1 * 11/2003 Yamamoto et al. ..... 101/148
2003/0217659 A1 * 11/2003 Yamamoto et al. ..... 101/350.1

FOREIGN PATENT DOCUMENTS

EP 1 138 266 A1 9/2001
JP 2000-318131 11/2000

* cited by examiner

*Primary Examiner*—Charles H. Nolan, Jr.
*Assistant Examiner*—Wasseem H. Hamdan
(74) *Attorney, Agent, or Firm*—McDermott Will & Emery LLP

(57) ABSTRACT

After an ink feeding rate or a dampening water feeding rate is varied, a variation in the ink feeding rate or dampening water feeding rate is prohibited for a waiting period. The waiting period for prohibiting a variation in the ink feeding rate is determined by a pattern area rate of a corresponding region. The waiting period for prohibiting a variation in the dampening water feeding rate is determined by an average pattern area rate of all regions or a minimum pattern area rate among pattern area rates of all regions. When one of the ink feeding rate and dampening water feeding rate is varied, a variation in the other feeding rate is prohibited for a set period of time.

19 Claims, 11 Drawing Sheets

PRINTING MACHINE FOR CONTROLLING FEEDING RATES BY COLOR DENSITY MEASUREMENT

BACKGROUND OF THE INVENTION

1. Field of the Invention

This invention relates to a printing machine that controls an ink feeding rate and a dampening water feeding rate by measuring the color density of prints produced.

2. Description of the Related Art

Such a printing machine includes ink feeders for adjusting the rates of feeding inks to ink rollers. Each ink feeder has a plurality of ink keys juxtaposed in a direction perpendicular to a direction for transporting printing paper in time of printing. The rate of feeding ink to the ink rollers is adjusted by varying the opening degree of each ink key. In this way, the rate of feeding ink ultimately to the printing plate is adjusted.

The printing machine further includes dampening water feeders for adjusting the rate of feeding dampening water to dampening form rollers. Each dampening water feeder includes a water source having a water vessel for storing dampening water and a fountain roller rotatable by a motor, and dampening form rollers for transferring dampening water from the fountain roller to the surface of the printing plate. Such a dampening water feeder can adjust the rate of feeding dampening water to the surface of the printing plate by varying the rotational frequency of the fountain roller.

The printing plate has regions called detecting patches or control strips formed in positions corresponding to the respective ink keys. The opening degree of each ink key and the rotational frequency of the water fountain roller are adjusted by measuring, with a densitometer, the color density of the corresponding detecting patch actually printed on printing paper.

In a printing operation of the printing machine, the color density of prints may not attain a predetermined value immediately after start of the printing operation even though the opening degree of each ink key in the ink feeder is proper. In such a case, when the color density of prints is measured and the feeding rates of ink and dampening water are automatically controlled, the opening degree of each ink key and the rotational frequency of the water fountain roller are further adjusted even though the feeding rates of ink and water are proper.

To avoid such a situation, adjustments of the opening degree of each ink key and the rotational frequency of the water fountain roller are prohibited immediately after start of a printing operation, or until a predetermined number of sheets are printed or until elapse of a fixed time after the feeding rate of ink or dampening water is adjusted.

However, where a long prohibition time is set for prohibiting adjustment of the opening degree of each ink key until a predetermined number of sheets are printed or until elapse of a fixed time after the feeding rate of ink or dampening water is adjusted, the feeding rate of ink or dampening water cannot be controlled quickly. This results in the inconvenience of consuming a long time before the color density of prints actually produced attains a target value.

SUMMARY OF THE INVENTION

The object of this invention, therefore, is to provide a printing machine for allowing the color density of prints to attain a target value quickly by appropriately controlling a prohibition time for prohibiting variations in the feeding rate of ink or dampening water.

The above object is fulfilled, according to this invention, by a printing machine for controlling an ink feeding rate and a dampening water feeding rate by measuring color density of prints produced, wherein, after a variation in one of the ink feeding rate and the dampening water feeding rate, a variation in the ink feeding rate or the dampening water feeding rate is prohibited for a predetermined waiting period.

This printing machine appropriately controls a prohibition time for prohibiting a variation in the ink feeding rate or dampening water feeding rate. This effectively avoids the above-noted inconvenience of consuming a long time before the color density of actual prints attains a target value.

In one preferred embodiment, the waiting period is determined by a set-number-of-sheets printing time required for printing a predetermined number of sheets of printing paper.

Preferably, the waiting period is determined based on a pattern area rate of a pattern to be printed.

The waiting period may be extended when the pattern area rate is less than a predetermined value.

In a further preferred embodiment, after a variation in one of the ink feeding rate and the dampening water feeding rate, a variation in the ink feeding rate is prohibited for a set-number-of-sheets printing time required for printing a predetermined number of sheets of printing paper.

Other features and advantages of the present invention will be apparent from the following detailed description of the embodiments of the invention.

BRIEF DESCRIPTION OF THE DRAWINGS

This invention may be embodied in other specific forms without departing from the spirit or essential attributes thereof and, accordingly, reference should be made to the appended claims, rather than to the foregoing specification, as indicating the scope of the invention.

DESCRIPTION OF THE PREFERRED EMBODIMENTS

An embodiment of the invention will be described hereinafter with reference to the drawings.

Figure 1:
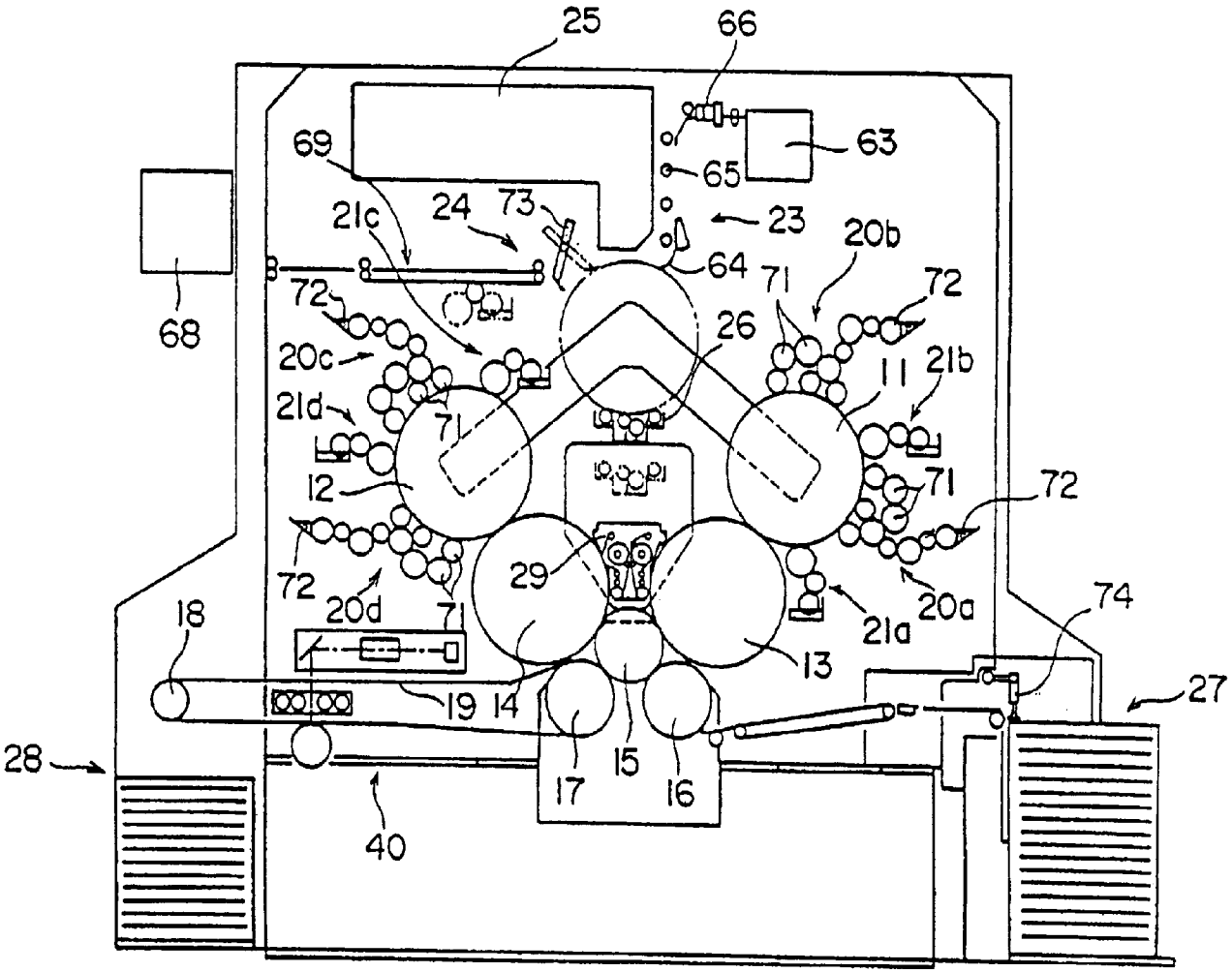
FIG. 1 is a schematic side view of a printing machine according to this invention.

FIG. 1 is a schematic side view of a printing machine according to the invention.

This printing machine records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The machine further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, an image pickup station 40 for measuring color densities of detecting patches printed on the printing paper, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is driven by a motor not shown to rotate synchronously with the first blanket cylinder 13. In the second printing position, the second plate cylinder 12 is rotatable synchronously with the second blanket cylinder 14. Adjacent the image recording position is a plate cylinder rotating mechanism, not shown, for rotating the first or second plate cylinder 11 or 12 whichever is in the image recording position.

The plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of grippers, not shown, for gripping the forward and rear ends of the plate fed from the plate feeder 23.

The plate remover 24 has a pawl mechanism 73 for separating a plate from the first or second plate cylinder 11 or 12 after a printing operation, a discharge cassette 68, and a conveyor mechanism 69 for transporting the plate separated by the pawl mechanism 73 to the discharge cassette 68.

The forward end of the plate drawn from the feeder cassette 63 is guided by the guide rollers 65 and guide member 64, and gripped by one of the grippers on the first or second plate cylinder 11 or 12. Then, the first or second plate cylinder 11 or 12 is rotated by the plate cylinder rotating mechanism not shown, whereby the plate is wrapped around the first or second plate cylinder 11 or 12. The rear end of the plate cut by the cutter 66 is gripped by the other gripper. While, in this state, the first or second plate cylinder 11 or 12 is rotated at low speed, the image recorder 25 irradiates the surface of the plate mounted peripherally of the first or second plate cylinder 11 or 12 with a modulated laser beam for recording images thereon.

Figure 2A:
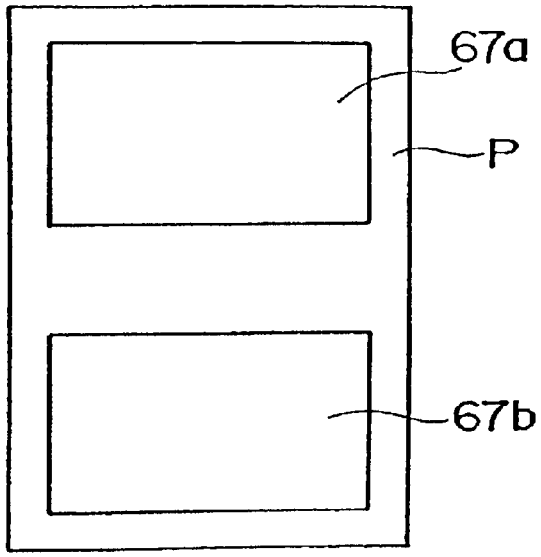
FIG. 2A is a plan view showing an arrangement of image areas, one for printing in black ink and the other for printing in magenta ink, on a printing plate mounted peripherally of a first plate cylinder.
Figure 2B:
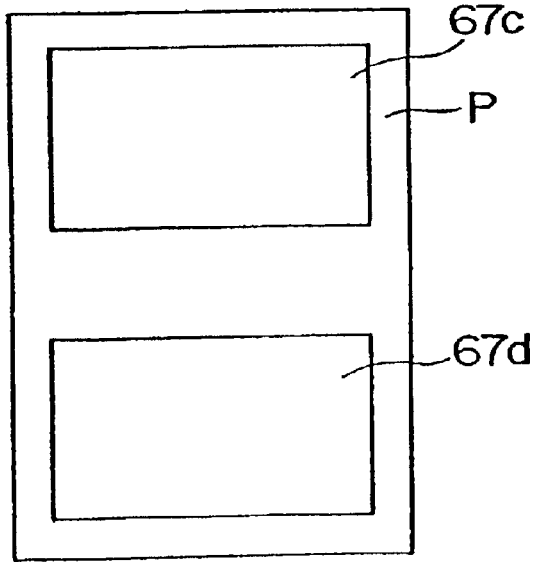
FIG. 2B is a plan view showing an arrangement of image areas, one for printing in cyan ink and the other for printing in yellow ink, on a printing plate mounted peripherally of a second plate cylinder.

On the plate P mounted peripherally of the first plate cylinder 11, the image recorder 25, as shown in FIG. 2A, records an image area 67*a* to be printed with black ink, and an image area 67*b* to be printed with magenta ink. On the plate P mounted peripherally of the second plate cylinder 12, the image recorder 25, as shown in FIG. 2B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an ink source 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

Figure 3:
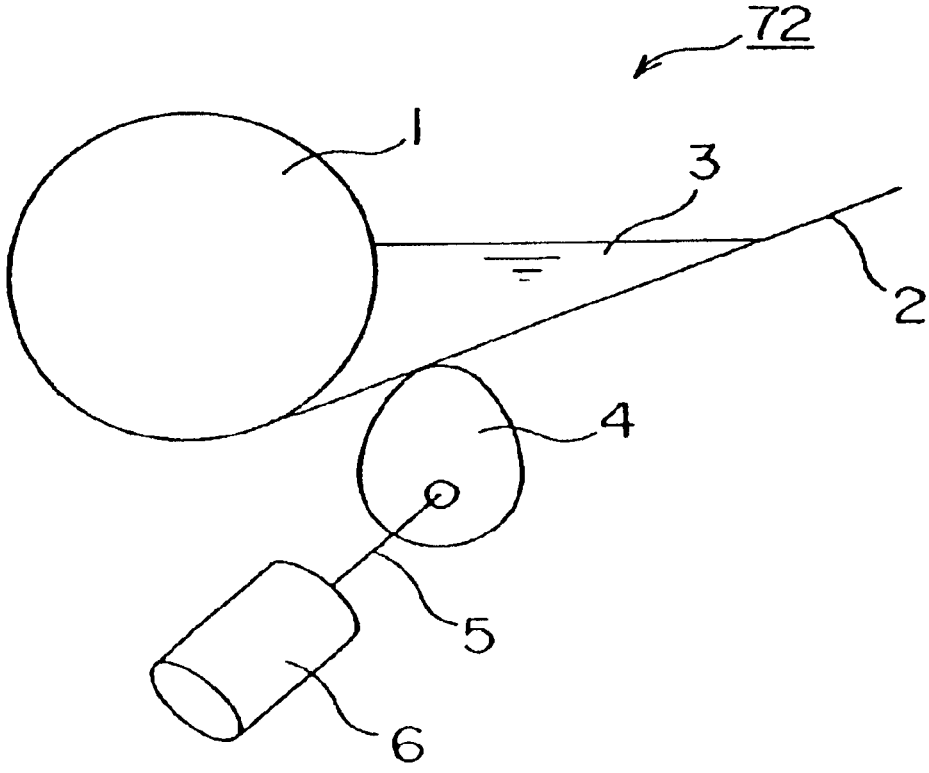
FIG. 3 is a schematic side view of an ink source.
Figure 4:
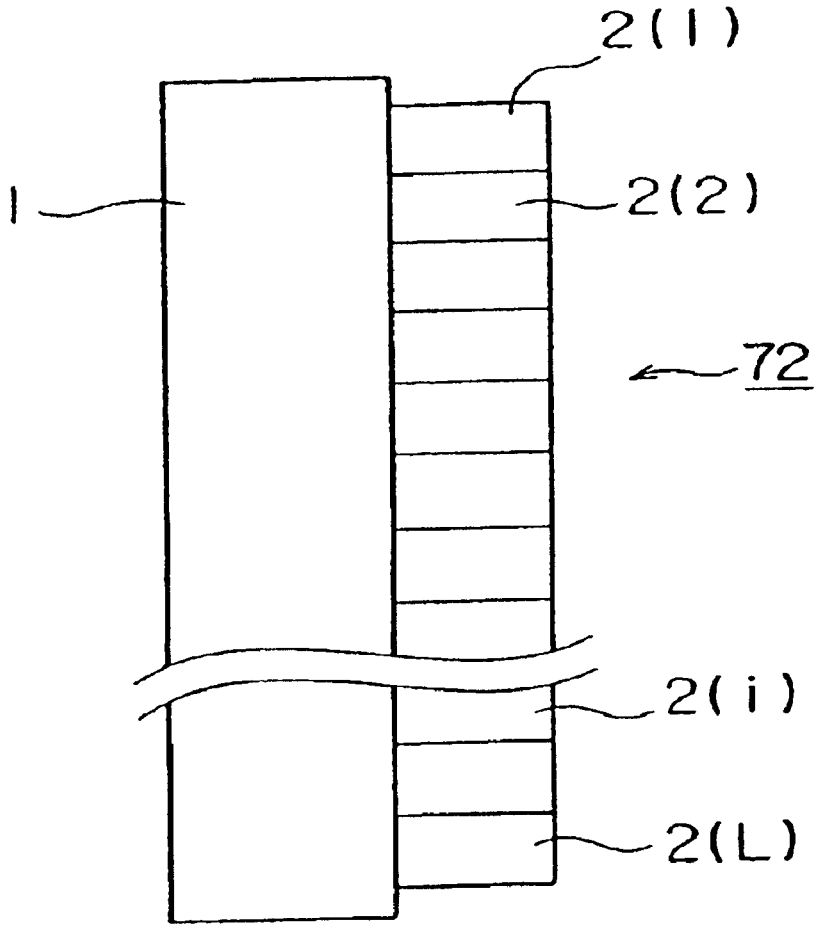
FIG. 4 is a plan view of the ink source.

FIG. 3 is a schematic side view of the ink source 72 noted above. FIG. 4 is a plan view thereof. Ink 3 is omitted from FIG. 4.

The ink source 72 includes an ink fountain roller 1 having an axis thereof extending in a direction of width of printed matter (i.e. perpendicular to a printing direction of the printing machine), and ink keys 2 (1), 2 (2) . . . 2 (L) arranged in the direction of width of the printed matter. In this specification, these ink keys may be collectively called "ink keys 2". The ink keys 2 correspond in number to the number L of areas divided in the direction of width of the printed matter. Each of the ink keys 2 has an adjustable opening degree with respect to the outer periphery of the ink fountain roller 1. The ink fountain roller 1 and ink keys 2 define an ink well for storing ink 3.

Eccentric cams 4, L in number, are arranged under the respective ink keys 2 for pressing the ink keys 2 toward the surface of ink fountain roller 1 to vary the opening degree of each ink key 2 with respect to the ink fountain roller 1. The eccentric cams 4 are connected through shafts 5 to pulse motors 6, L in number, for rotating the eccentric cams 4, respectively.

Each pulse motor 6, in response to an ink key drive pulse applied thereto, rotates the eccentric cam 4 about the shaft 5 to vary a pressure applied to the ink key 2. The opening degree of the ink key 2 with respect to the ink fountain roller 1 is thereby varied to vary the rate of ink fed to the printing plate.

Referring again to FIG. 1, the dampening water feeders 21*a*, 21*b*, 21*c* and 21*d* (which may be referred to collectively as "dampening water feeders 21") feed dampening water to the plates P before the ink feeders 20 feed the inks thereto. Of the dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

Figure 5:
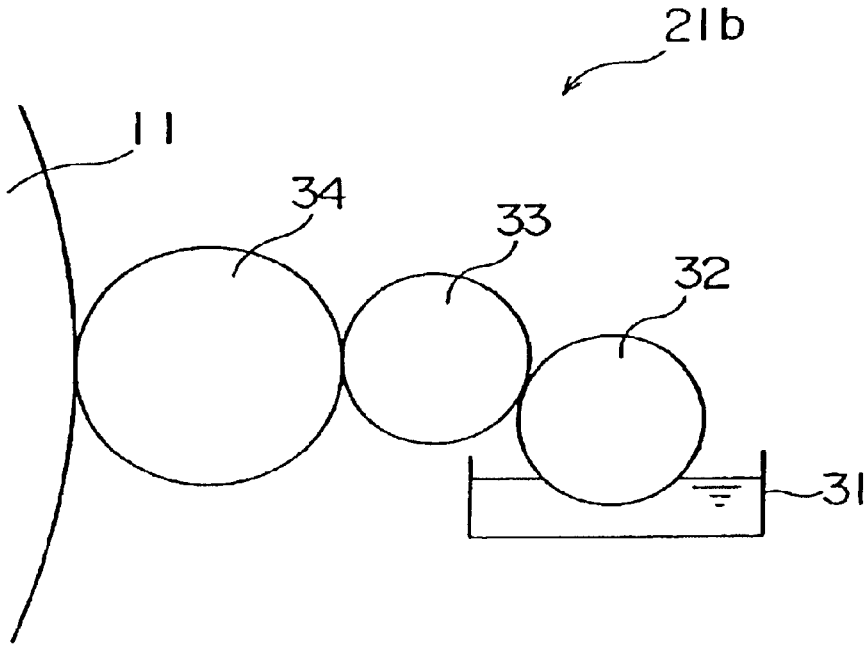
FIG. 5 is a schematic side view of a dampening water feeder.

FIG. 5 is a schematic side view of the dampening water feeder 21*b*.

The dampening water feeder 21*b* includes a water source having a water vessel 31 for storing dampening water and a water fountain roller 32 rotatable by a motor, not shown, and two dampening form rollers 33 and 34 for transferring dampening water from the fountain roller 32 to the surface of the plate mounted peripherally of the first plate cylinder 11. This dampening water feeder is capable of adjusting the rate of feeding dampening water to the surface of the plate by varying the rotating rate of fountain roller 32.

The three other water feeders 21*a*, 21*c* and 21*d* have the same construction as the water feeder 21*b*.

Referring again to FIG. 1, the developing device 26 is disposed under the first plate cylinder 11 or second plate cylinder 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit, fixing unit and squeezing unit are successively brought into contact with the plate P rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism not shown.

The blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers 41 arranged thereon. When the impression cylinder 15 transfers the printing paper to the discharge cylinder 17, one of the grippers 41 of the discharge cylinder 17 holds the forward end of the printing paper having been held by the gripper of the impression cylinder 15. With movement of the chains 19, color densities of the detecting patches printed on the printing paper are measured at the image pickup station 40. Thereafter the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 6:
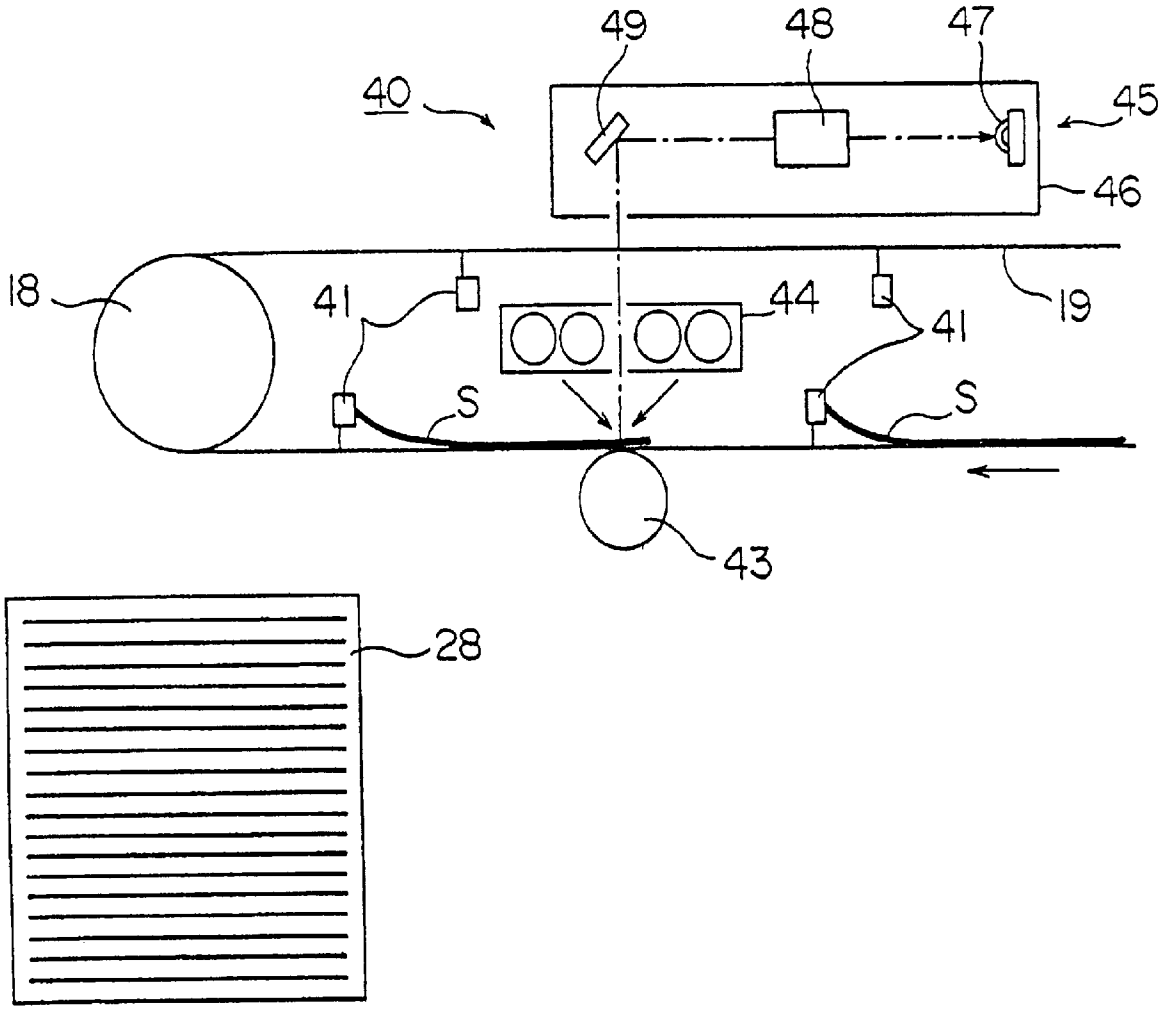
FIG. 6 is a schematic side view of an image pickup station shown with chains.

FIG. 6 is a schematic side view of the image pickup station 40 for measuring color densities of the detecting patches printed on the printing paper, which is shown with the chains 19.

The pair of chains 19 are endlessly wound around the opposite ends of the paper discharge cylinder 17 shown in FIG. 1 and a pair of large sprockets 18. As noted hereinbefore, the chains 19 are interconnected by coupling members, not shown, having a plurality of grippers 41 arranged thereon each for gripping a forward end of printing paper S transported.

The pair of chains 19 have a length corresponding to a multiple of the circumference of paper discharge cylinder 17. The grippers 41 are arranged on the chains 19 at intervals each corresponding to the circumference of paper discharge cylinder 17. Each gripper 41 is opened and closed by a cam mechanism, not shown, synchronously with the gripper on the paper discharge cylinder 17. Thus, each gripper 41 receives printing paper S from the paper discharge cylinder 17, transports the printing paper S with rotation of the chains 19, and discharges the paper S to the paper discharge station 28.

The printing paper S is transported with only the forward end thereof held by one of the grippers 41, the rear end of printing paper S not being fixed. Consequently, the printing paper S could flap during transport, which impairs an operation, to be described hereinafter, of the image pickup station 40 to measure densities of the detecting patches. To avoid such an inconvenience, this printing machine provides a suction roller 43 disposed upstream of the paper discharge station 28 for stabilizing the printing paper S transported.

The suction roller 43 is in the form of a hollow roller having a surface defining minute suction bores, with the hollow interior thereof connected to a vacuum pump not shown. The suction roller 43 is disposed to have an axis thereof extending parallel to the grippers 41 bridging the pair of chains 19, a top portion of the suction roller 43 being substantially at the same height as a lower run of the chains 19.

The suction roller 43 is driven to rotate or freely rotatable in a matching relationship with a moving speed of the grippers 41. Thus, the printing paper S is drawn to the surface of the suction roller 43, thereby being held against flapping when passing over the suction roller 43. In place of the suction roller 43, a suction plate may be used to suck the printing paper S two-dimensionally.

The image pickup station 40 includes an illuminating unit 44 for illuminating the printing paper S transported, and an image pickup unit 45 for picking up images of the detecting patches on the printing paper S illuminated by the illuminating unit 44 and measuring color densities of the patches. The illuminating unit 44 is disposed between the upper and lower runs of chains 19 to extend along the suction roller 43, and has a plurality of linear light sources for illuminating the printing paper S over the suction roller 43.

The image pickup unit 45 includes a light-shielding and dustproof case 46, and a mirror 49, a lens 48 and a CCD line sensor 47 arranged inside the case 46. The image pickup unit 45 picks up the image of printing paper S over the suction roller 43 through slits of the illuminating unit 44. Incident light of the image reflected by the mirror 49 passes through the lens 48 to be received by the CCD line sensor 47.

Figure 7:
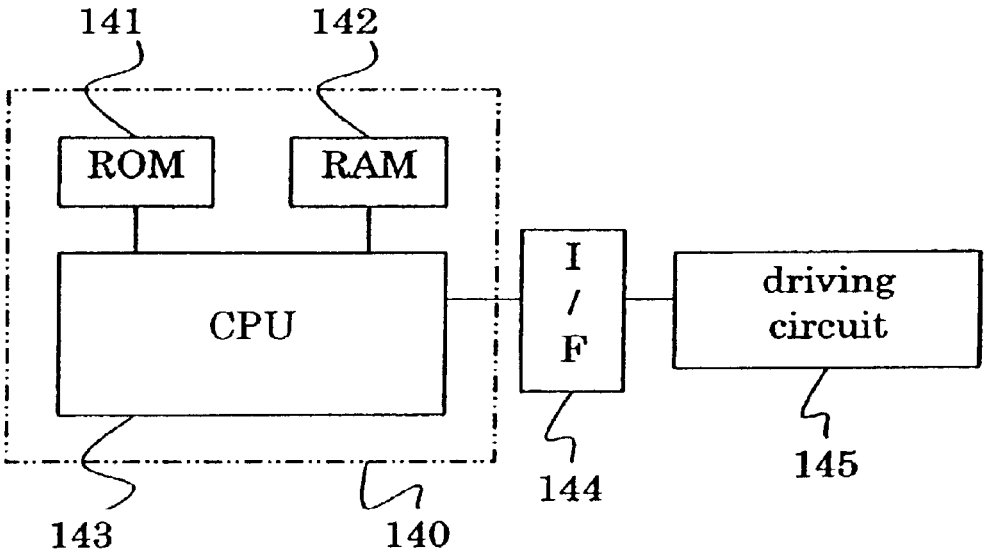
FIG. 7 is a block diagram of a principal electrical structure of the printing machine.

FIG. 7 is a block diagram showing a principal electrical structure of the printing machine. This printing machine includes a control unit 140 having a ROM 141 for storing operating programs necessary for controlling the machine, a RAM 142 for temporarily storing data and the like during a control operation, and a CPU 143 for performing logic operations. The control unit 140 has a driving circuit 145 connected thereto through an interface 144, for generating driving signals for driving the ink feeders 20, dampening water feeders 21, image recorder 25, developing device 26, blanket cleaning unit 29, image pickup station 40, the contact mechanisms for the first and second blanket cylinders 13 and 14, and so on. The printing machine is controlled by the control unit 140 to execute prepress and printing operations as described hereinafter.

Figure 8:
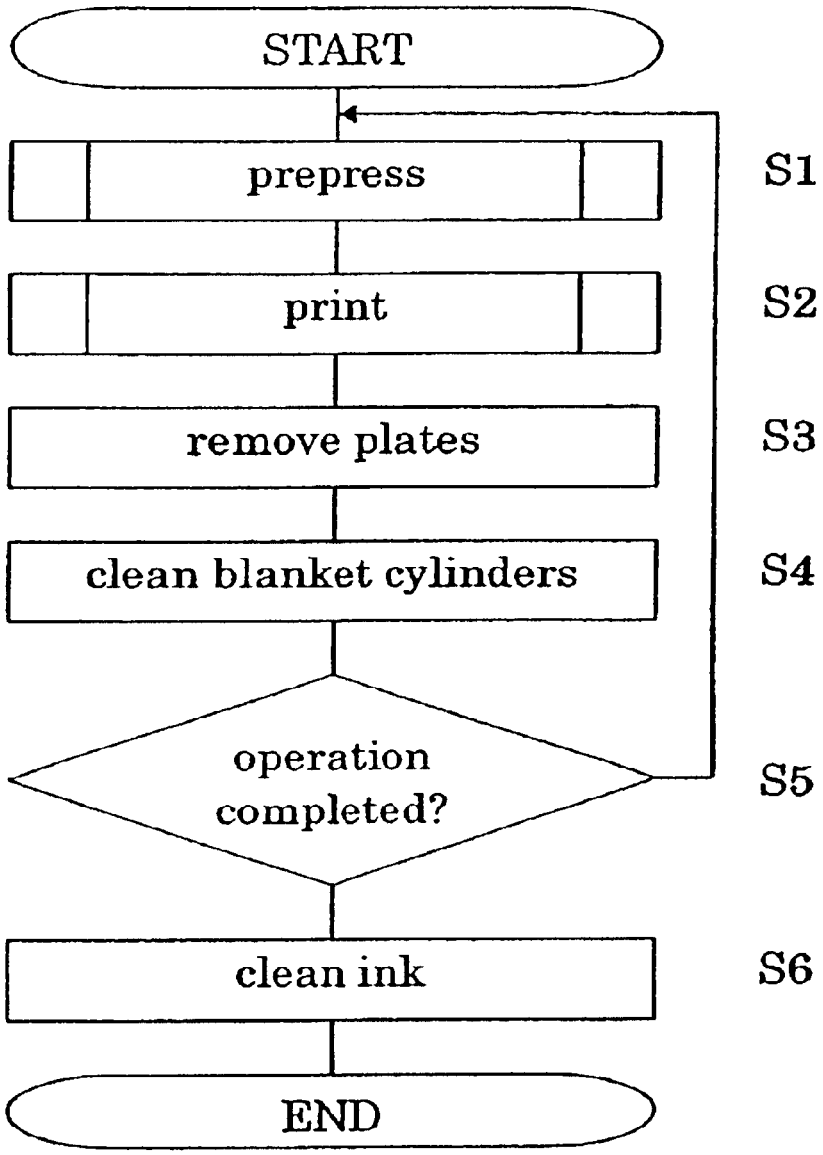
FIG. 8 is a flow chart of prepress and printing operations of the printing machine.

The prepress and printing operations of the printing machine will be described next. FIG. 8 is a flow chart showing an outline of the prepress and printing operations of the printing machine. These prepress and printing operations are directed to multicolor printing of printing paper S with the four color inks of yellow, magenta, cyan and black.

Figure 9:
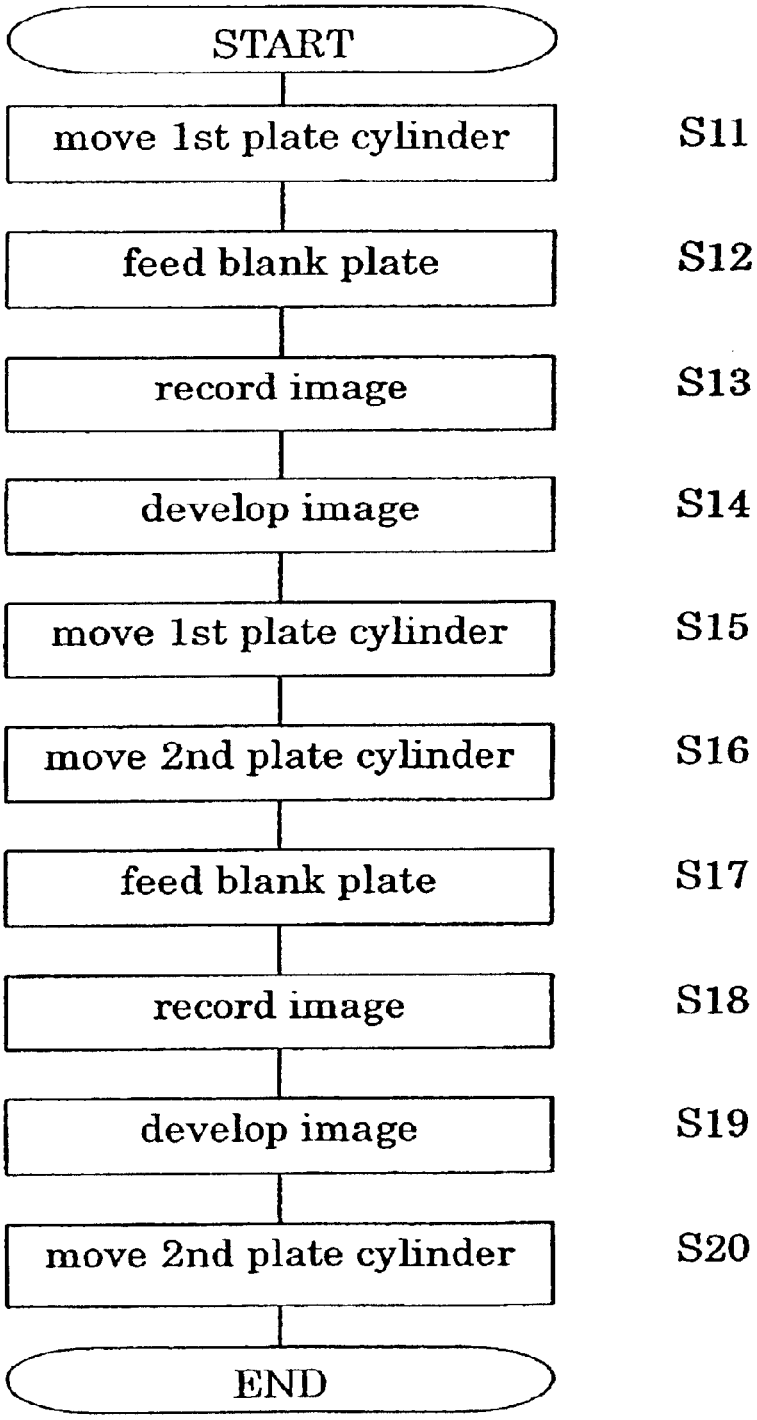
FIG. 9 is a flow chart of a prepress process.

First, the printing machine executes a prepress process for recording and developing images on the plates P mounted on the first and second plate cylinders 11 and 12 (step S1). This prepress process follows the steps constituting a subroutine as shown in the flow chart of FIG. 9.

The first plate cylinder 11 is first moved to the image recording position shown in the two-dot chain line in FIG. 1. (step S11).

Next, a plate P is fed to the outer periphery of the first plate cylinder 11 (step S12). To achieve the feeding of the plate P, the pair of grippers, not shown, grip the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed.

Next, the image recorded on the plate P is developed (step S14). The developing step is executed by raising the developing device 26 from the standby position shown in two-dot chain lines to the developing position shown in solid lines in FIG. 1 and thereafter successively moving the developing unit, fixing unit and squeezing unit into contact with the plate P rotating with the first plate cylinder 11.

Upon completion of the developing step, the first plate cylinder 11 is moved to the first printing position shown in the solid line in FIG. 1 (step S15).

Subsequently, the printing machine carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 8, the prepress process is followed by a printing process for printing the printing paper S with the plates P mounted on the first and second plate cylinders 11 and 12 (step S2). This printing process is carried out as follows.

First, each dampening water feeder 21 and each ink feeder 20 are placed in contact with only a corresponding one of the image areas on the plates P mounted on the first and second plate cylinders 11 and 12. Consequently, dampening water and inks are fed to the image areas 67*a*, 67*b*, 67*c* and 67*d* from the corresponding dampening water feeders 21 and ink feeders 20, respectively. These inks are transferred from the plates P to the corresponding regions of the first and second blanket cylinders 13 and 14, respectively.

Then, the printing paper S is fed to the paper feed cylinder 16. The printing paper S is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper S wrapped around the impression cylinder 15 in its first rotation, and the magenta and yellow inks in its second rotation.

The forward end of the printing paper S printed in the four colors is passed from the impression cylinder 15 to the paper discharge cylinder 17. This printing paper S is transported by the pair of chains 19 toward the paper discharge station 28. After the color densities of the detecting patches are measured at the image pickup station 40, the printing paper S is discharged to the paper discharge station 28.

Upon completion of the printing process, the plates P used in the printing are removed (step S3). To remove the plates P, the first plate cylinder 11 is first moved to the image recording position shown in the two-dot chain line in FIG. 1. Then, while the first plate cylinder 11 is rotated counterclockwise, the pawl mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the image recording position to undergo an operation similar to the above, thereby having the plate P removed from the second plate cylinder 12 for discharge into the discharge cassette 68.

Upon completion of the plate removing step, the first and second blanket cylinders 13 and 14 are cleaned by the blanket cleaning unit 29 (step S4).

After completing the cleaning of the first and second blanket cylinders 13 and 14, the printing machine determines whether or not a further image is to be printed (step S5). If a further printing operation is required, the machine repeats steps S1 to S4.

If the printing operation is ended, the printing machine cleans the inks (step S6). For cleaning the inks, an ink cleaning device, not shown, provided for each ink feeder 20 removes the ink adhering to the ink rollers 71 and ink source 72 of each ink feeder 20.

With completion of the ink cleaning step, the printing machine ends the entire process.

The printing machine having the above construction uses detecting patches also known as control scales to control the rates of feeding ink to the printing plates P.

Figure 10:
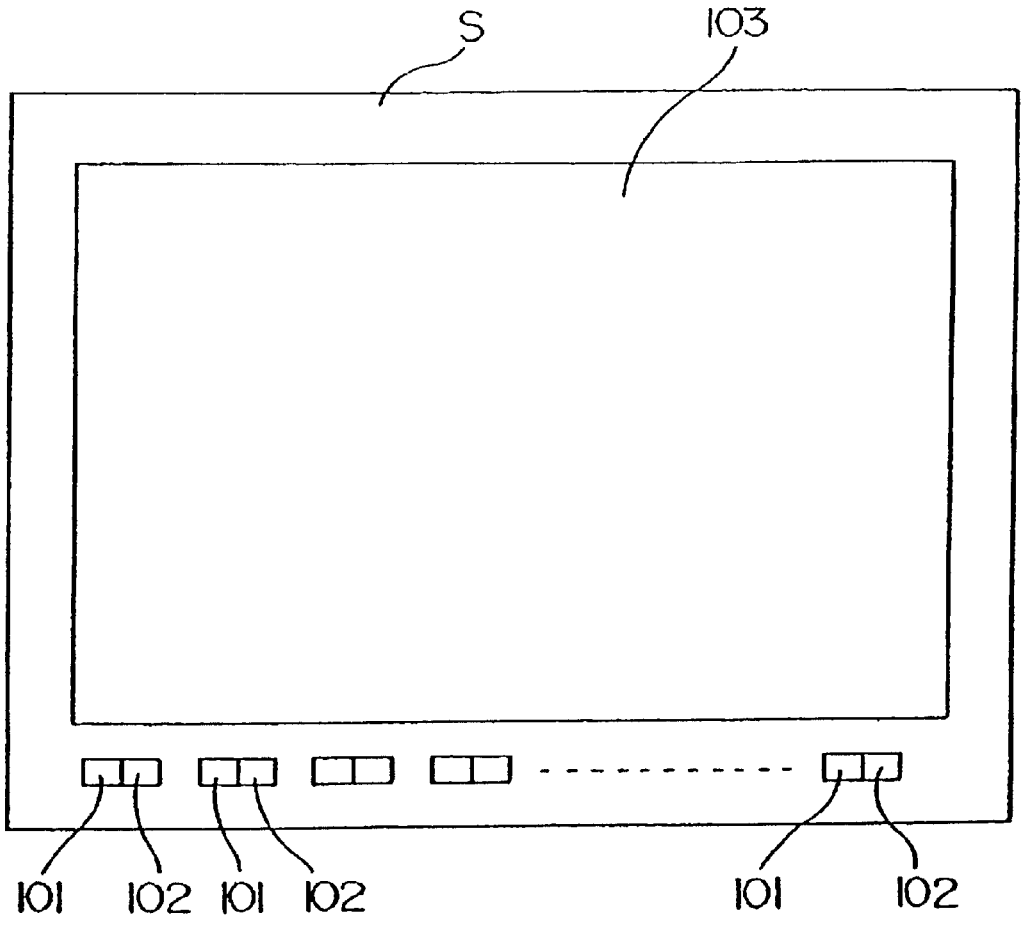
FIG. 10 is an explanatory view of first detecting patches and second detecting patches.

FIG. 10 is an explanatory view showing first detecting patches (first control strips) 101 and second detecting patches (second control strips) 102 printed on printing paper S after a printing process.

These first and second detecting patches 101 and 102 are printed in areas between one end of the printing paper S and an end of an image area 103 on the printing paper S. The first detecting patches 101 and second detecting patches 102 are arranged in discrete, adjacent pairs, L in number corresponding to the number L of areas divided in the direction of width of the printed matter (i.e. perpendicular to the printing direction of the printing machine), as are the ink keys 2 noted above. The material used for the first detecting patches 101 has a large halftone area ratio, or solid patches are used, while the material used for the second detecting patches 102 has a small halftone area ratio.

Operations for controlling the rates of feeding ink and dampening water will be described next. In the printing process described above (step S2), a variation in the feeding rate of ink or dampening water is prohibited for a waiting period following a variation in the feeding rate of ink or dampening water.

Figure 11:
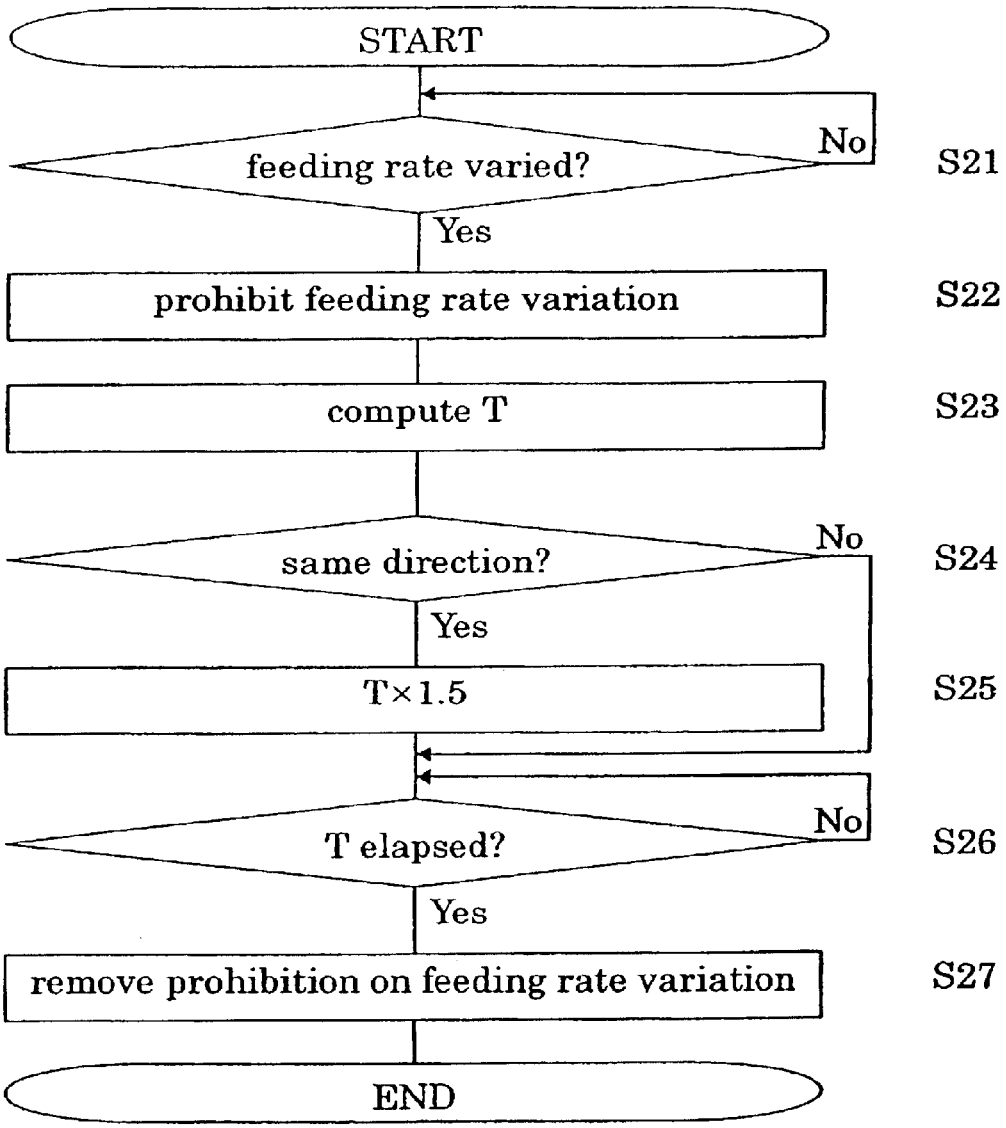
FIG. 11 is a flow chart of an operation for adjusting the ink feeding rate in the printing machine according to this invention.

The operation for controlling the ink feeding rate will be described first. FIG. 11 is a flow chart of an operation for adjusting the ink feeding rate in the printing machine according to this invention.

When, in the printing process (step S2) shown in FIG. 8, the feeding rate of ink or dampening water is varied (step S21), a variation in the ink feeding rate is prohibited (step S22). Then, a computation is carried out to determine a waiting period for prohibiting a variation in the ink feeding rate. This waiting period is determined by a set-number-of-sheets printing time required to print a predetermined number of sheets of printing paper S. This set-number-of-sheets printing time is computed as set out below.

A set-number-of-sheets printing time required for printing a predetermined number of sheets, e.g. 20 sheets, of printing paper S is set as basic time T0 beforehand. When the pattern area rate α of a region corresponding to each ink key 2 is 20% or less, a corrected set-number-of-sheets printing time T is derived from the following equation (1) (step S23):

$$T=T0\times(1+0.1\times n) \quad (1)$$

where n=(20−α).

When, for example, the pattern area rate α of a certain region is 15%, the set-number-of-sheets printing time T for the ink key 2 corresponding to that area is 20×(1+0.1×5)=30, and thus a time required for printing 30 sheets of printing papers S.

A long set-number-of-sheets printing time is set as the waiting period when the pattern area rate has a predetermined value or less, as noted above. This is done for the following reason. When the density of ink actually applied to the printing paper S exceeds a set density, it is difficult to reduce the density for a region having a low pattern area rate α. Consequently, a large number of sheets of printing paper S are printed in improper density. A long set-number-of-sheets printing time T is set as the waiting period to secure a high safety factor.

The pattern area rate α is computed from image data obtained from images recorded by the image recorder 25.

After computing the set-number-of-sheets printing time T, a checking is made whether the current variation in the ink feeding rate is effected in the same direction as the preceding variation in the feeding rate (step S24). As long as the current variation in the ink feeding rate is effected in the same direction as the preceding variation in the feeding rate, a new set-number-of-sheets printing time T is determined by multiplying the above-noted set-number-of-sheets printing time T by 1.5 (step S25).

Specifically, a new set-number-of-sheets printing time T is determined by multiplying the above-noted set-number-of-sheets printing time T by 1.5 when the preceding variation was effected in a direction to increase the ink feeding rate and the current variation also is effected in the same feeding rate increasing direction, or when the preceding variation was effected in a direction to decrease the ink feeding rate and the current variation also is effected in the same feeding rate decreasing direction. For step S25, the waiting period is set based on the preceding ink feeding rate.

The prohibition on a variation in the ink feeding rate is maintained until elapse of the set-number-of-sheets printing time T. After elapse of the set-number-of-sheets printing time T, the prohibition on a variation in the ink feeding rate is removed (step S27).

The operation for controlling the feeding rate of dampening water is basically the same as the operation for controlling the ink feeding rate shown in FIG. 11. However, the ink feeding rate may be controlled for the region corresponding to each ink key 2 by varying the opening degree of each ink key 2. The dampening water feeding rate is varied by means of the rotational frequency of water fountain roller 32 shown in FIG. 5. Thus, the water feeding rate cannot be varied for each region, unlike the ink feeding rate.

In the case of dampening water, the set-number-of-sheets printing time T is computed (step S23) not by using the pattern area rate $\alpha$ of a certain region but by using an average pattern area rate of regions or a minimum pattern area rate which is a pattern area rate of a region having the lowest pattern area rate $\alpha$.

In this printing machine, when one of the feeding rates of ink and dampening water is varied, a variation in the other feeding rate is prohibited for a period of time determined experimentally beforehand.

When, for example, the color density of prints increases with a decrease in the quantity of dampening water, the color density of prints may be decreased by correspondingly lowering the ink feeding rate. In this case, when the dampening water is further decreased in quantity, the color density of prints will be increased with the result that the ink feeding rate is to be further decreased. In such a state, the feeding rates of both ink and dampening water are insufficient so that the prints give a rough impression.

Conversely, when the color density of prints decreases with an increase in the quantity of dampening water, the color density of prints may be increased by correspondingly increasing the ink feeding rate. In this case, when the dampening water is further increased in quantity, the color density of prints will be decreased with the result that the ink feeding rate is to be further increased. In such a state, the feeding rates of both ink and dampening water are excessive so that the prints become clammy.

In this printing machine, therefore, when one of the ink feeding rate and the damping water feeding rate is varied, a variation in the other feeding rate is prohibited for a predetermined period of time. In this way, the vicious circle noted above is avoided.

The various operations described above are controlled by the control unit 140 shown in FIG. 7. The control unit 140 acts as a variation prohibiting device for prohibiting, after a variation in one of the ink feeding rate and the dampening water feeding rate, a variation in the ink feeding rate or the dampening water feeding rate for a waiting period, and a prohibiting device for prohibiting, when varying one of the ink feeding rate and the dampening water feeding rate, a variation in the other for a predetermined period.

In the foregoing embodiment, the invention is applied to the printing machine that performs a printing operation by recording images on blank printing plates mounted on the first and second plate cylinders 11 and 12, and transferring inks supplied to the printing plates through the first and second blanket cylinders 13 and 14 to printing paper held on the impression cylinder 15. However, this invention is applicable also to other, ordinary printing machines.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2002-146696 filed in the Japanese Patent Office on May 21, 2002, the entire disclosure of which is incorporated herein by reference.

What is claimed is:

1. A printing machine for controlling an ink feeding rate and a dampening water feeding rate by measuring color density of prints produced, said machine comprising:

a plate cylinder;

a plate for recording images mounted on said plate cylinder;

an ink feeder for feeding ink to said plate;

a dampening water feeder for feeding dampening water to said plate;

a driving circuit for generating driving signals for driving said ink feeder and said dampening water feeder based on an ink feeding rate and a dampening water feeding rate; and a control unit connected to said driving circuit and configured for controlling said ink feeding rate and said dampening water feeding rate, and acting as a variation prohibitive device for prohibiting, after a variation in one of said ink feeding rate and said dampening water feeding rate, a variation of said driving signals in said ink feeding rate or said dampening water feeding rate for a predetermined waiting period.

2. A printing machine as defined in claim 1, wherein said waiting period is determined by a set-number-of-sheets printing time required for printing a predetermined number of sheets of printing paper.

3. A printing machine as defined in claim 1, wherein said waiting period is determined based on an ink feeding rate set last time or a dampening water feeding rate set last time.

4. A printing machine as defined in claim 1, wherein said waiting period is determined based on a pattern area rate of a pattern to be printed.

5. A printing machine as defined in claim 4, wherein said waiting period is extended when said pattern area rate is less than a predetermined value.

6. A printing machine as defined in claim 4, wherein said waiting period for prohibiting a variation in said ink feeding rate is determined by a pattern area rate of a corresponding region.

7. A printing machine as defined in claim 4, wherein said waiting period for prohibiting a variation in said dampening water feeding rate is determined by an average pattern area rate of all regions or a minimum pattern area rate among pattern area rates of all regions.

8. A printing machine for controlling an ink feeding rate and a dampening water feeding rate by measuring color density of prints produced, said machine comprising:

a plate cylinder;

a plate for recording images mounted on said plate cylinder;

an ink feeder for feeding ink to said elate;

a dampening water feeder for feeding dampening water to said plate;

a driving circuit for generating driving signals for driving said ink feeder and said dampening water feeder based on an ink feeding rate and a dampening water feeding rate; and a control unit connected to said driving circuit and configured for controlling said ink feeding rate and said dampening water feeding rate and acting as a variation prohibitive device for prohibiting, after a variation in one of said ink feeding rate and said dampening water feeding rate, a variation of said driving signals in said ink feeding rate for a set-number-of-sheets printing time required for printing a predetermined number of sheets of printing paper.

9. A printing machine as defined in claim 8, wherein said set-number-of-sheets printing time is determined based on a pattern area rate of a pattern to be printed.

10. A printing machine as defined in claim 9, wherein said waiting period is extended when said pattern area rate is less than a predetermined value.

11. A printing machine as defined in claim 10, wherein said set-number-of-sheets printing time is determined based on an ink feeding rate set last time.

12. A printing machine having a pattern pickup unit for measuring color density of detecting patches printed on printing paper, an ink feeding rate and a dampening water feeding rate being controlled by detecting, with the image pickup unit, the detecting patches on prints produced, said machine comprising:

a plate cylinder;

a plate for recording images mounted on said plate cylinder;

an ink feeder for feeding ink to said plate;

a dampening water feeder for feeding dampening water to said plate;

a driving circuit for generating driving signals for driving said ink feeder and said dampening water feeder based on an ink feeding rate and a dampening water feeding rate; and a control unit connected to said driving circuit and configured for controlling said ink feeding rate and said dampening water feeding rate, and acting as a variation prohibitive device for prohibiting, after a variation in one of said ink feeding rate and said dampening water feeding rate, a variation of said driving signals in said ink feeding rate or said dampening water feeding rate for a predetermined waiting period.

13. A printing machine as defined in claim 12, wherein said waiting period is determined by a set-number-of-sheets printing time required for printing a predetermined number of sheets of printing paper.

14. A printing machine as defined in claim 12, wherein said waiting period is determined based on an ink feeding rate set last time or a dampening water feeding rate set last time.

15. A printing machine as defined in claim 14, wherein said waiting period for prohibiting a variation in said ink feeding rate is determined by a pattern area rate of a corresponding region.

16. A printing machine as defined in claim 14, wherein said waiting period for prohibiting a variation in said dampening water feeding rate is determined by an average pattern area rate of all regions or a minimum pattern area rate among pattern area rates of all regions.

17. A printing machine as defined in claim 12, wherein said waiting period is determined based on a pattern area rate of a pattern to be printed.

18. A printing machine as defined in claim 17, further comprising an image recording unit for recording images on printing plates, wherein said pattern area rate is computed from image data provided when the images are recorded by said image recording unit.

19. A printing machine as defined in claim 18, wherein said waiting period is extended when said pattern area rate is less than a predetermined value.

* * * * *